US007530942B1

(12) United States Patent
Diab

(10) Patent No.: US 7,530,942 B1
(45) Date of Patent: May 12, 2009

(54) REMOTE SENSING INFANT WARMER

(75) Inventor: Mohamed Kheir Diab, Mission Viejo, CA (US)

(73) Assignee: Masimo Corporation, Irvine, CA (US)

( * ) Notice: Subject to any disclaimer, the term of this patent is extended or adjusted under 35 U.S.C. 154(b) by 0 days.

(21) Appl. No.: 11/583,355

(22) Filed: Oct. 18, 2006

Related U.S. Application Data

(60) Provisional application No. 60/727,728, filed on Oct. 18, 2005.

(51) Int. Cl.
*A61G 11/00* (2006.01)

(52) U.S. Cl. ..... 600/22

(58) Field of Classification Search ..... 600/22; 374/1, 183; 345/607; 392/418; 219/218; 250/330, 339.02
See application file for complete search history.

(56) References Cited

U.S. PATENT DOCUMENTS 4,960,128 A 10/1990 Gordon et al.
4,964,408 A 10/1990 Hink et al.
5,041,187 A 8/1991 Hink et al.
5,069,213 A 12/1991 Polczynski
5,163,438 A 11/1992 Gordon et al.
5,272,340 A 12/1993 Anbar
5,337,744 A 8/1994 Branigan
5,341,805 A 8/1994 Stavridi et al.
D353,195 S 12/1994 Savage et al.
D353,196 S 12/1994 Savage et al.
5,377,676 A 1/1995 Vari et al.
D359,546 S 6/1995 Savage et al.
5,431,170 A 7/1995 Mathews
D361,840 S 8/1995 Savage et al.
D362,063 S 9/1995 Savage et al.
5,452,717 A 9/1995 Branigan et al.
D363,120 S 10/1995 Savage et al.
5,456,252 A 10/1995 Vari et al.
5,482,036 A 1/1996 Diab et al.
5,490,505 A 2/1996 Diab et al.
5,494,043 A 2/1996 O'Sullivan et al.
5,533,511 A 7/1996 Kaspari et al.
5,561,275 A 10/1996 Savage et al.
5,562,002 A 10/1996 Lalin
5,590,649 A 1/1997 Caro et al.
5,602,924 A 2/1997 Durand et al.
5,632,272 A 5/1997 Diab et al.
5,638,816 A 6/1997 Kiani-Azarbayjany et al.
5,638,818 A 6/1997 Diab et al.
5,645,440 A 7/1997 Tobler et al.
5,685,299 A 11/1997 Diab et al.
D393,830 S 4/1998 Tobler et al.
5,743,262 A 4/1998 Lepper, Jr. et al.
5,758,644 A 6/1998 Diab et al.
5,760,910 A 6/1998 Lepper, Jr. et al.
5,769,785 A 6/1998 Diab et al.
5,782,757 A 7/1998 Diab et al.
5,785,659 A 7/1998 Caro et al.
5,791,347 A 8/1998 Flaherty et al.

(Continued)

*Primary Examiner*—John P Lacyk
(74) *Attorney, Agent, or Firm*—Knobbe, Martens, Olson & Bear LLP

(57) ABSTRACT

An infant is illuminated with heater radiant energy so as to warm the infant. A detector remotely senses infant radiated energy so as to determine the extent of infant warmth, and a controller responsive to the detector regulates the heater radiant energy accordingly. Skin-reflected heater radiant energy is limited at least during measurements of infant radiated energy.

16 Claims, 5 Drawing Sheets

U.S. PATENT DOCUMENTS

| | | | |
|---|---|---|---|
| 5,810,734 | A | 9/1998 | Caro et al. |
| 5,823,950 | A | 10/1998 | Diab et al. |
| 5,830,131 | A | 11/1998 | Caro et al. |
| 5,833,618 | A | 11/1998 | Caro et al. |
| 5,841,944 | A | 11/1998 | Hutchinson et al. |
| 5,860,919 | A | 1/1999 | Kiani-Azarbayjany et al. |
| 5,890,929 | A | 4/1999 | Mills et al. |
| 5,898,817 | A | 4/1999 | Salmon et al. |
| 5,904,654 | A | 5/1999 | Wohltmann et al. |
| 5,919,134 | A | 7/1999 | Diab |
| 5,934,925 | A | 8/1999 | Tobler et al. |
| 5,940,182 | A | 8/1999 | Lepper, Jr. et al. |
| 5,980,449 | A | 11/1999 | Benson et al. |
| 5,995,855 | A | 11/1999 | Kiani et al. |
| 5,997,343 | A | 12/1999 | Mills et al. |
| 6,002,952 | A | 12/1999 | Diab et al. |
| 6,011,986 | A | 1/2000 | Diab et al. |
| 6,027,452 | A | 2/2000 | Flaherty et al. |
| 6,036,642 | A | 3/2000 | Diab et al. |
| 6,045,509 | A | 4/2000 | Caro et al. |
| 6,067,462 | A | 5/2000 | Diab et al. |
| 6,081,735 | A | 6/2000 | Diab et al. |
| 6,088,607 | A | 7/2000 | Diab et al. |
| 6,110,522 | A | 8/2000 | Lepper, Jr. et al. |
| 6,124,597 | A | 9/2000 | Shehada et al. |
| 6,144,868 | A | 11/2000 | Parker |
| 6,151,516 | A | 11/2000 | Kiani-Azarbayjany et al. |
| 6,152,754 | A | 11/2000 | Gerhardt et al. |
| 6,157,850 | A | 12/2000 | Diab et al. |
| 6,165,005 | A | 12/2000 | Mills et al. |
| 6,184,521 | B1 | 2/2001 | Coffin, IV et al. |
| 6,206,830 | B1 | 3/2001 | Diab et al. |
| 6,229,856 | B1 | 5/2001 | Diab et al. |
| 6,232,609 | B1 | 5/2001 | Snyder et al. |
| 6,236,872 | B1 | 5/2001 | Diab et al. |
| 6,241,683 | B1 | 6/2001 | Macklem et al. |
| 6,245,010 | B1 | 6/2001 | Jones |
| 6,256,523 | B1 | 7/2001 | Diab et al. |
| 6,263,222 | B1 | 7/2001 | Diab et al. |
| 6,270,452 | B1 | 8/2001 | Donnelly et al. |
| 6,278,522 | B1 | 8/2001 | Lepper, Jr. et al. |
| 6,280,213 | B1 | 8/2001 | Tobler et al. |
| 6,285,896 | B1 | 9/2001 | Tobler et al. |
| 6,321,100 | B1 | 11/2001 | Parker |
| 6,334,065 | B1 | 12/2001 | Al-Ali et al. |
| 6,343,224 | B1 | 1/2002 | Parker |
| 6,349,228 | B1 | 2/2002 | Kiani et al. |
| 6,360,114 | B1 | 3/2002 | Diab et al. |
| 6,368,283 | B1 | 4/2002 | Xu et al. |
| 6,371,921 | B1 | 4/2002 | Caro et al. |
| 6,377,829 | B1 | 4/2002 | Al-Ali |
| 6,388,240 | B2 | 5/2002 | Schulz et al. |
| 6,397,091 | B2 | 5/2002 | Diab et al. |
| 6,430,525 | B1 | 8/2002 | Weber et al. |
| 6,463,311 | B1 | 10/2002 | Diab |
| 6,464,627 | B1 | 10/2002 | Falk |
| 6,470,199 | B1 | 10/2002 | Kopotic et al. |
| 6,500,111 | B1 | 12/2002 | Salmon |
| 6,501,975 | B2 | 12/2002 | Diab et al. |
| 6,505,059 | B1 | 1/2003 | Kollias et al. |
| 6,515,273 | B2 | 2/2003 | Al-Ali |
| 6,519,487 | B1 | 2/2003 | Parker |
| 6,525,386 | B1 | 2/2003 | Mills et al. |
| 6,526,300 | B1 | 2/2003 | Kiani et al. |
| 6,541,756 | B2 | 4/2003 | Schulz et al. |
| 6,542,764 | B1 | 4/2003 | Al-Ali et al. |
| 6,580,086 | B1 | 6/2003 | Schulz et al. |
| 6,584,336 | B1 | 6/2003 | Ali et al. |
| 6,585,636 | B2 * | 7/2003 | Jones et al. ..... 600/22 |
| 6,595,316 | B2 | 7/2003 | Cybulski et al. |
| 6,597,932 | B2 | 7/2003 | Tian et al. |
| 6,597,933 | B2 | 7/2003 | Kiani et al. |
| 6,606,511 | B1 | 8/2003 | Ali et al. |
| 6,632,181 | B2 | 10/2003 | Flaherty et al. |
| 6,639,668 | B1 | 10/2003 | Trepagnier |
| 6,640,116 | B2 | 10/2003 | Diab |
| 6,643,530 | B2 | 11/2003 | Diab et al. |
| 6,650,917 | B2 | 11/2003 | Diab et al. |
| 6,653,605 | B2 | 11/2003 | Kneuer |
| 6,654,624 | B2 | 11/2003 | Diab et al. |
| 6,658,276 | B2 | 12/2003 | Kianl et al. |
| 6,661,161 | B1 | 12/2003 | Lanzo et al. |
| 6,671,531 | B2 | 12/2003 | Al-Ali et al. |
| 6,673,007 | B2 | 1/2004 | Salmon et al. |
| 6,678,543 | B2 | 1/2004 | Diab et al. |
| 6,684,090 | B2 | 1/2004 | Ali et al. |
| 6,684,091 | B2 | 1/2004 | Parker |
| 6,697,656 | B1 | 2/2004 | Al-Ali |
| 6,697,657 | B1 | 2/2004 | Shehada et al. |
| 6,697,658 | B2 | 2/2004 | Al-Ali |
| RE38,476 | E | 3/2004 | Diab et al. |
| 6,699,194 | B1 | 3/2004 | Diab et al. |
| 6,714,804 | B2 | 3/2004 | Al-Ali et al. |
| RE38,492 | E | 4/2004 | Diab et al. |
| 6,719,780 | B1 | 4/2004 | Salmon et al. |
| 6,721,582 | B2 | 4/2004 | Trepagnier et al. |
| 6,721,585 | B1 | 4/2004 | Parker |
| 6,725,075 | B2 | 4/2004 | Al-Ali |
| 6,728,560 | B2 | 4/2004 | Kollias et al. |
| 6,735,459 | B2 | 5/2004 | Parker |
| 6,745,060 | B2 | 6/2004 | Diab et al. |
| 6,760,607 | B2 | 7/2004 | Al-Ali |
| 6,761,683 | B2 | 7/2004 | Gryn et al. |
| 6,770,028 | B1 | 8/2004 | Ali et al. |
| 6,771,994 | B2 | 8/2004 | Kiani et al. |
| 6,792,300 | B1 | 9/2004 | Diab et al. |
| 6,813,511 | B2 | 11/2004 | Diab et al. |
| 6,816,741 | B2 | 11/2004 | Diab |
| 6,822,564 | B2 | 11/2004 | Al-Ali |
| 6,826,419 | B2 | 11/2004 | Diab et al. |
| 6,830,711 | B2 | 12/2004 | Mills et al. |
| 6,835,172 | B2 | 12/2004 | Falk |
| 6,850,787 | B2 | 2/2005 | Weber et al. |
| 6,850,788 | B2 | 2/2005 | Al-Ali |
| 6,852,083 | B2 | 2/2005 | Caro et al. |
| 6,861,639 | B2 | 3/2005 | Al-Ali |
| 6,898,452 | B2 | 5/2005 | Al-Ali et al. |
| 6,920,345 | B2 | 7/2005 | Al-Ali et al. |
| 6,931,268 | B1 | 8/2005 | Kiani-Azarbayjany et al. |
| 6,934,570 | B2 | 8/2005 | Kiani et al. |
| 6,939,305 | B2 | 9/2005 | Flaherty et al. |
| 6,943,348 | B1 | 9/2005 | Coffin, IV |
| 6,950,687 | B2 | 9/2005 | Al-Ali |
| 6,953,427 | B1 * | 10/2005 | Mackin et al. ..... 600/22 |
| 6,961,598 | B2 | 11/2005 | Diab |
| 6,970,792 | B1 | 11/2005 | Diab |
| 6,979,812 | B2 | 12/2005 | Al-Ali |
| 6,985,764 | B2 | 1/2006 | Mason et al. |
| 6,993,371 | B2 | 1/2006 | Kiani et al. |
| 6,996,427 | B2 | 2/2006 | Ali et al. |
| 6,999,904 | B2 | 2/2006 | Weber et al. |
| 7,003,338 | B2 | 2/2006 | Weber et al. |
| 7,003,339 | B2 | 2/2006 | Diab et al. |
| 7,015,451 | B2 | 3/2006 | Dalke et al. |
| 7,024,233 | B2 | 4/2006 | Ali et al. |
| 7,026,609 | B2 * | 4/2006 | Bartonek ..... 250/252.1 |
| 7,027,849 | B2 | 4/2006 | Al-Ali |
| 7,030,749 | B2 | 4/2006 | Al-Ali |
| 7,039,449 | B2 | 5/2006 | Al-Ali |
| 7,041,060 | B2 | 5/2006 | Flaherty et al. |
| 7,044,918 | B2 | 5/2006 | Diab |
| 7,067,893 | B2 | 6/2006 | Mills et al. |
| 7,096,052 | B2 | 8/2006 | Mason et al. |
| 7,096,054 | B2 | 8/2006 | Abdul-Hafiz et al. |

7,132,641 B2 11/2006 Schulz et al.
7,142,901 B2 11/2006 Kiani et al.
7,149,561 B2 12/2006 Diab
7,186,966 B2 3/2007 Al-Ali
7,190,261 B2 3/2007 Al-Ali
7,215,984 B2 5/2007 Diab
7,215,986 B2 5/2007 Diab
7,221,971 B2 5/2007 Diab
7,225,006 B2 5/2007 Al-Ali et al.
7,225,007 B2 5/2007 Al-Ali
RE39,672 E 6/2007 Shehada et al.
7,239,905 B2 7/2007 Kiani-Azarbayjany et al.
7,245,953 B1 7/2007 Parker
7,254,431 B2 8/2007 Al-Ali
7,254,433 B2 8/2007 Diab et al.
7,254,434 B2 8/2007 Schulz et al.
7,272,425 B2 9/2007 Al-Ali
7,274,955 B2 9/2007 Kiani et al.
D554,263 S 10/2007 Al-Ali
7,280,858 B2 10/2007 Al-Ali et al.
7,289,835 B2 10/2007 Mansfield et al.
7,292,883 B2 11/2007 De Felice et al.
7,295,866 B2 11/2007 Al-Ali
2002/0161276 A1 * 10/2002 Mountain ..... 600/22

* cited by examiner

REMOTE SENSING INFANT WARMER

CROSS-REFERENCE TO RELATED APPLICATIONS

The present application claims priority benefit under 35 U.S.C. § 119(e) to U.S. Provisional Patent Application Ser. No. 60/727,728, filed Oct. 18, 2005, entitled Remote Sensing Infant Warmer, which is incorporated by reference herein.

BACKGROUND OF THE INVENTION

An infant warmer is used in maternity and newborn care facilities to maintain a small or premature infant at a desired temperature. FIG. 1 illustrates a conventional infant warmer 100 having a heater element 110, a skin-mounted thermistor 120 and a control system 130. The heater element 110 radiates heat to provide warmth to an infant. The thermistor 120 measures the infant's skin temperature. The control system 130 regulates the heater element 110 based on the measured skin temperature.

SUMMARY OF THE INVENTION

A conventional infant warmer is inaccurate and inconvenient in regulating infant warmth. In particular, a skin-mounted thermistor only measures the temperature at a small patch of skin, but skin temperature can vary across different areas of an infant's body. A thermistor can also be dislodged, creating a risk of over- or under-heating. In particular, a conventional infant warmer may have trouble detecting a partially dislodged thermistor that measures between ambient and skin temperatures or a thermistor that slowly detaches over time. Further, it is a nuisance to mount and remove a thermistor each time an infant is moved to or from a conventional infant warmer. A remote sensing infant warmer advantageously eliminates these limitations of a skin-mounted temperature sensor.

One aspect of an infant warmer is a base, a tray mounted above the base, a support extending from the base and a fixture mounted to the support and extending over the tray. A radiant heater is disposed within the fixture and configured to emit radiant energy so as to warm an infant placed in the tray. A detector is disposed proximate the fixture and configured to receive infant radiated energy. A controller in communications with the detector and the radiant heater is configured to vary the radiant energy from the radiant heater based upon the infant radiated energy so as to provide closed-loop regulation of infant warmth.

In various embodiments, the infant warmer has an alarm responsive to the controller so as to indicate an anomalous infant temperature. A detector optic corresponds to the detector and determines at least one of detector field-of-view, detector focus and received radiation bandwidth. A heater optic corresponds to the radiant heater and determines at least one of bandwidth of the radiant energy, area within the tray exposed to the radiant energy, and location within the tray exposed to the radiant energy. An interruptor at least partially blocks the heater radiant energy intermittently so that radiant energy reflected from infant skin is at least substantially reduced at the detector during measurements of infant temperature. A controller derives a thermal image of an infant placed within the tray based upon an output of the detector, wherein the controller varies at least one of the detector optic, the heater optic and a distance from the tray to the radiant heater in response to the thermal image. In one embodiment, the interrupter is a chopper wheel that signals the controller when an opaque window passes between the radiant heater and the infant. In another embodiment, the interrupter is a shutter positioned between the radiant heater and the infant, the shutter responsive to a signal from the controller to close during measurements of infant temperature.

Another aspect of an infant warmer provides a heater to generate radiant energy to be absorbed by at least a portion of an infant. Infant radiated energy responsive to the heater radiant energy is remotely sensed. The heater radiant energy that reaches the infant is adjusted so as to control infant warmth. In an embodiment, a detector responsive to the infant radiated energy is adjusted so as to view the infant, and the detector response is output to a controller that provides a closed-loop adjustment of the heater radiant energy that reaches the infant accordingly.

In various other embodiments, skin-reflected heater radiant energy is at least significantly prevented from reaching the detector. In an embodiment, the frequency of the heater radiant energy along the path from heater to detector is band-limited so as to at least significantly reduce heater radiant energy within a substantial bandwidth proximate the peak wavelength of the infant radiated energy. In an embodiment, at least one of a band-pass heater optic, a high-pass heater optic, a notch filter detector optic and a low-pass detector optic is provided. In an embodiment, the radiant energy is intermittently blocked from reaching the infant during measurements of the infant radiated energy. In an embodiment, at least one of temperature and on-off duty cycle of the radiant heater is modified in response to the measurements. In an embodiment, the distance between the infant and the radiant heater is modified in response to the measurements.

In another embodiment, an infant warmer has a tray means for holding an infant, a radiant heater means for warming an infant, a support means for positioning the radiant heater means so as to warm an infant, a detector means for remotely sensing infant radiated energy, and a controller means for close-loop regulation of infant warmth in response to an output from the detector means. In an embodiment, a limiting means at least reduces skin-reflected radiant heater energy from significantly affecting the accuracy of sensing infant radiated energy. In an embodiment, a measuring means estimates infant warmth from the infant radiated energy.

DETAILED DESCRIPTION OF THE PREFERRED EMBODIMENTS

Figure 1:
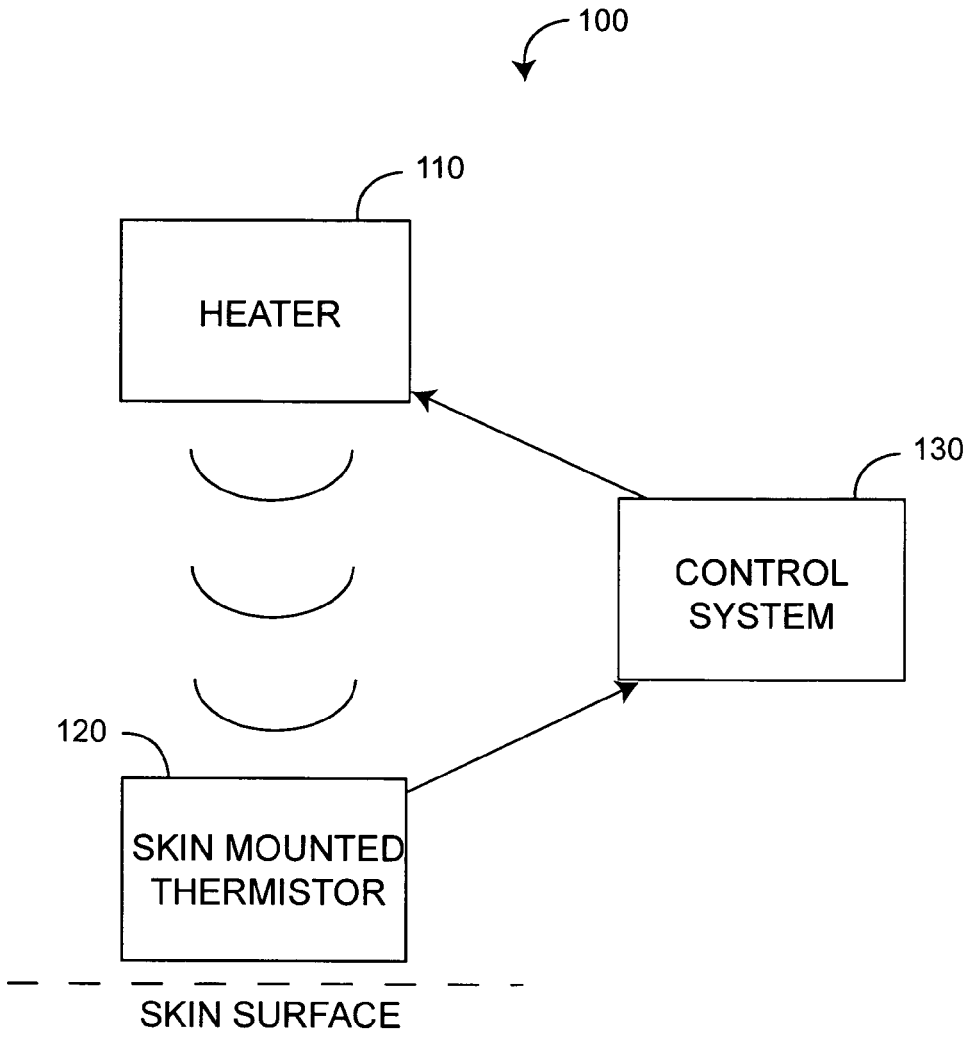
FIG. 1 (Prior Art)
FIG. 1 is a block diagram of a conventional infant warmer.
Figure 2:
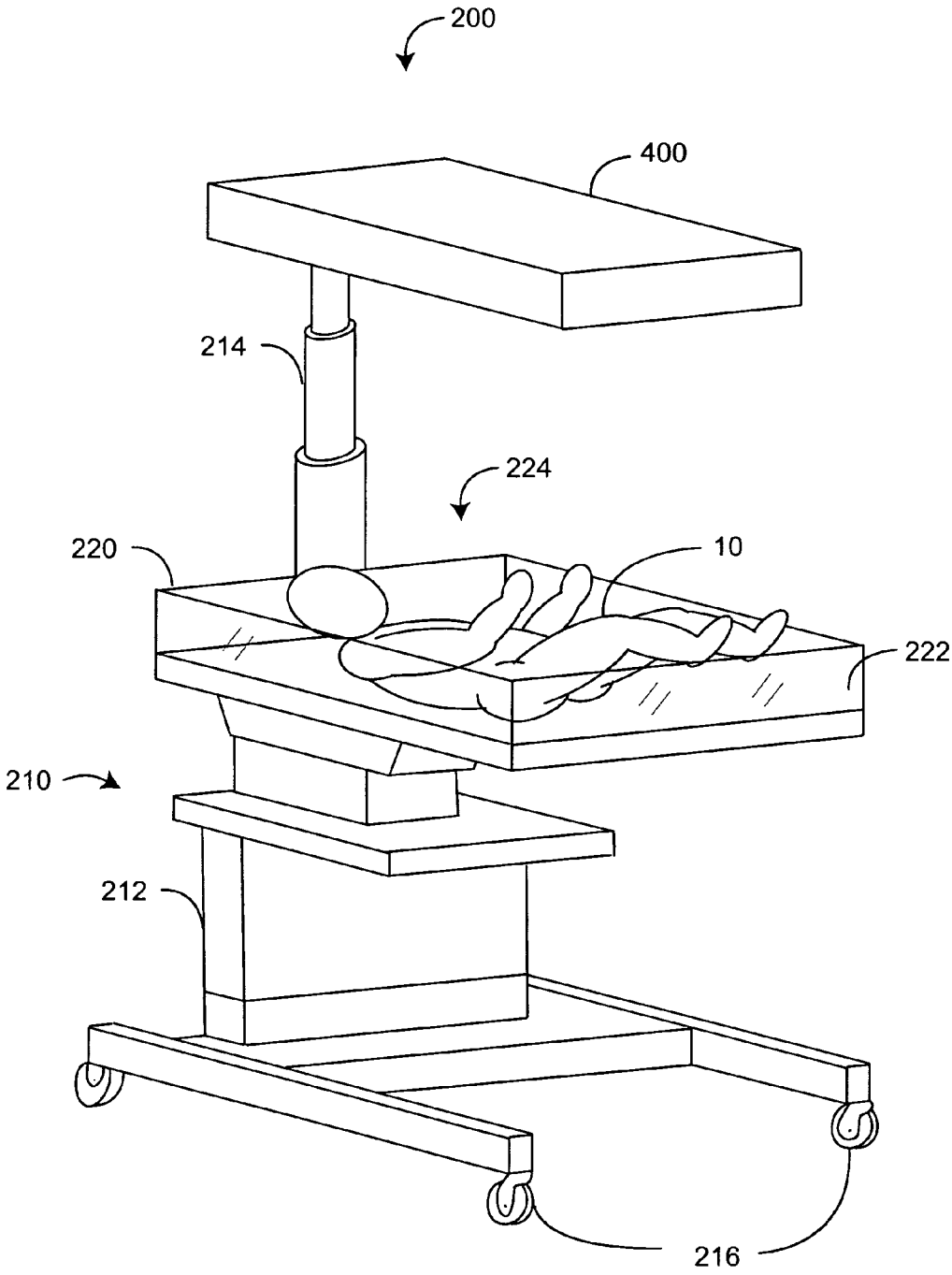
FIG. 2 is a front perspective view of a remote sensing infant warmer.

FIG. 2 illustrates a remote sensing infant warmer 200 having a stand 210, a tray 220 which holds an infant 10 and a heating fixture 400. Advantageously, a detector 420 (FIG. 4) and a controller 430 (FIG. 4) are disposed proximate the heating fixture 400 so that the detector 420 (FIG. 4) can remotely sense infant skin temperature and the controller 430 (FIG. 4) can adjust the infant warmer's radiated heat accordingly.

As shown in FIG. 2, transparent walls 222 contain the infant 10 safely within the tray 220. The tray 220 has an opening 224 exposed to the heating fixture 400. The stand 210 has a base 212 that mounts the tray 220 and a support 214 that mounts the heating fixture 400. Wheels 216 are attached to the base 212 for infant warmer mobility. The support 216 is adjustable so as to position the heating fixture 400 at various distances from the infant 10.

Figure 3:
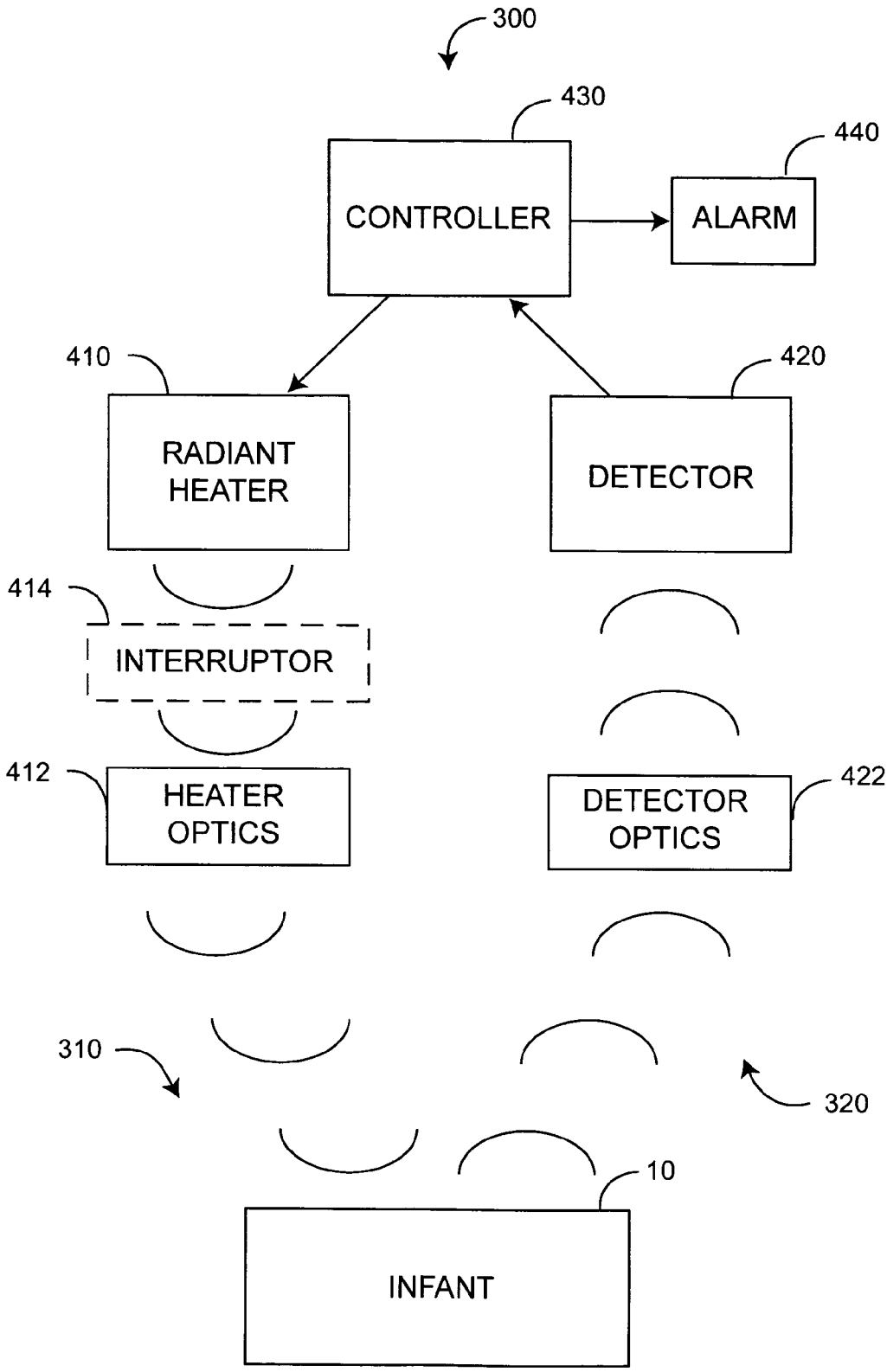
FIG. 3 is a block diagram of a remote sensing infant warmer.

FIG. 3 illustrates a control system 300 having a radiant heater 410, a detector 420 and a controller 430. The radiant heater 410 is located in the heating fixture 400 (FIG. 2) and radiates infrared (IR) energy 310 to warm an infant 10, which raises the infant's skin-temperature accordingly. The detector 420 is configured to remotely measure that skin temperature. In particular, the detector 420 senses infant-radiated IR energy 320, which can be used to estimate infant skin-temperature. In particular, the Planck Radiation Law governs blackbody radiation and can be used to derive the Stefan-Boltzmann Law and the Wien Displacement Law. The former indicates the relationship between the quantity of heat radiated by a black body and its temperature, and the latter provides a relationship between the wavelength having a peak radiation energy and the temperature of the radiating black body, as is well-known in the art. The controller 430 communicates with the detector 420 and the radiant heater 410 and is configured to vary the radiant heater energy 310 based upon an infant's skin temperature so as to provide closed-loop regulation of infant warmth.

As shown in FIG. 3, in an embodiment the control system 300 has one or more of heater optics 412, an interruptor 414 and detector optics 422. The optics 412, 422 can perform focusing and field-of-view (FOV) functions for the heater 410 and detector 420, respectively, as described with respect to FIG. 4. In an embodiment, one or more of the heater optics 412, interruptor 414 and detector optics 422 reduce or eliminate skin reflectance of radiant energy from the heater 410 into the detector 420, which has the potential to introduce error into the measurement of infant radiated energy and the derivation of infant temperature, as described with respect to FIG. 5, below.

In an embodiment, the controller 430 has an analog front-end that inputs a detector signal responsive to the intensity or wavelength or both of detected radiant energy and which filters and amplifies the detector signal accordingly. In an embodiment, the controller 430 further has an A/D converter that digitizes a front-end output and a digital signal processor that is programmed to input the digitized output so as to calculate temperature measurements accordingly, such as based upon the laws described above. In an embodiment, the controller 430 further has one or more analog and digital inputs and outputs for controlling, as examples, the radiant heater 410 radiated energy, receiving an interrupter 414 signal, controlling the interruptor 414, adjusting the support 214 (FIG. 2), adjusting the optics 412, 422, and adjusting the detector 420.

Figure 4:
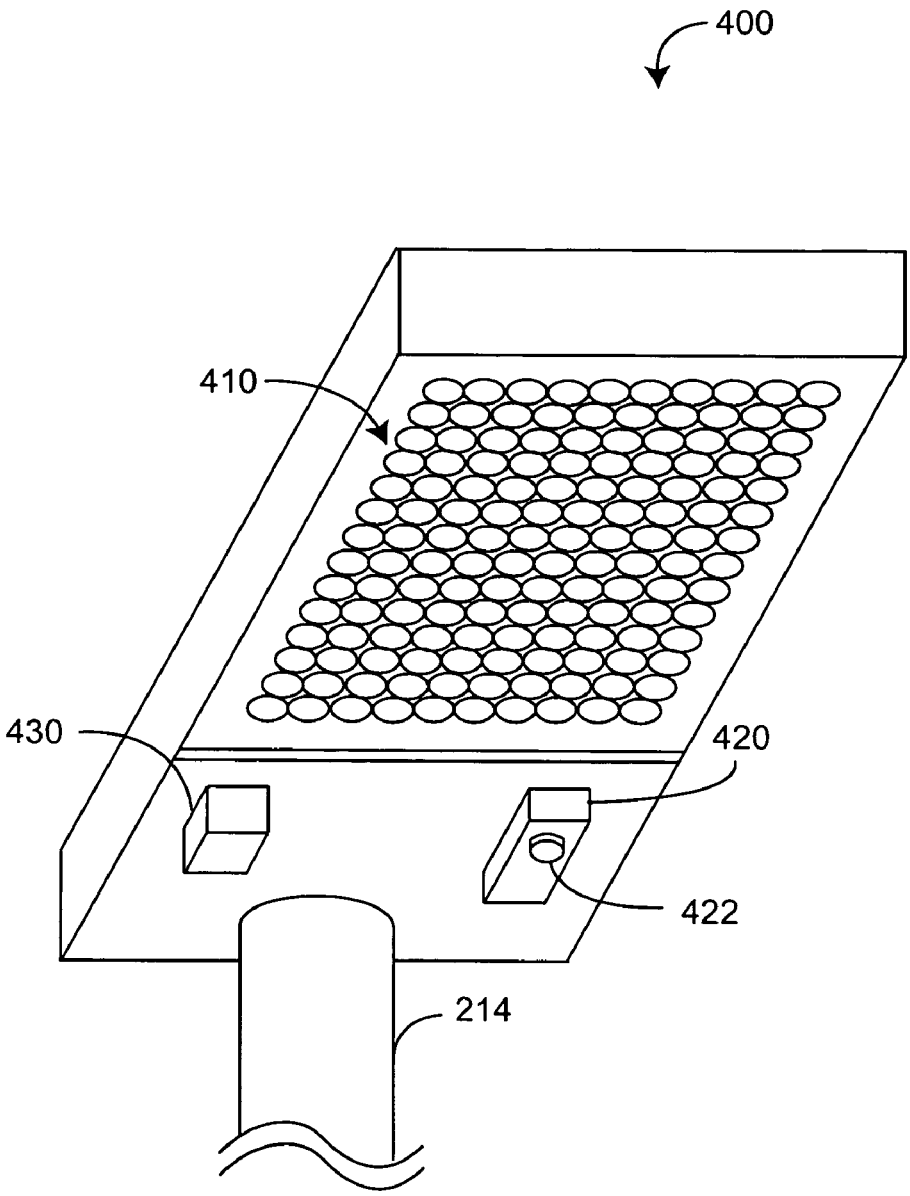
FIG. 4 is a bottom perspective view of a heating fixture.

FIG. 4 illustrates further detail of a heating fixture 400, having a radiant heater 410, a detector 420 configured to view within the tray 220 (FIG. 2) so as to remotely sense infant skin temperature and a controller 430. The radiant heater 410 may comprise a single radiating element or multiple elements. In an embodiment, the element or elements are heated electrically, for example, to a fixed or variable temperature. In an embodiment, the element or elements are infrared (IR) sources having fixed or variable intensity and narrow or broadband wavelengths. In one embodiment, the radiant heater 410 provides uniform heat throughout the area of the tray 220 (FIG. 2). In another embodiment, the radiant heater 410 has optics 412 (FIG. 3) such as lenses, mirrors or combinations of lenses and mirrors that focus heat on a predetermined portion within the tray 200 (FIG. 2) so as to heat a particular area of an infant. In an embodiment, the radiant heater lenses or mirrors 412 (FIG. 3) are adjustable, either manually or via the controller 430 so as to vary the distribution of heat within the tray 200 (FIG. 2), according to area or location or both. In one embodiment, the support 214 is adjustable via the controller 430, so as to control the distance between the tray 200 (FIG. 2) and the radiant heater 410.

Also shown in FIG. 4, in one embodiment, the detector 420 is mounted within the heating fixture 400. In alternative embodiments, the detector 420 is attached proximate the heating fixture 400, such as along the support 214 or extending from the fixture 400. In another embodiment, the detector 420 is positioned proximate the tray 220 (FIG. 2). The detector 420 is configured to remotely sense infrared (IR) radiation from an infant in the tray 220 (FIG. 2). In one embodiment, the detector 420 has a single sensing element so as to respond to an average body temperature. In another embodiment, the detector 420 comprises multiple sensing elements, fixed or scanned, so as to provide a thermal image of an infant in the tray 220 (FIG. 2). In an embodiment, the detector 420, the detector optics 422 or a combination of the detector 420 and the detector optics 422 are configured to be responsive to infant radiated energy according to wavelength so that the controller can determine a peak intensity wavelength. The detector 420 may also have optics 422, such as a lens, mirror, stop or combinations of these so as to vary its field-of-view (FOV) between a portion and the entirety of the tray 220 (FIG. 2), either manually or via the controller 430. The detector 420 may also be movable so as to focus its FOV on a particular area within the tray 220 (FIG. 2), either manually or via the controller 430, so as to sense a specific portion of an infant within the tray 220 (FIG. 2).

Further shown in FIG. 4, the controller 430 is mounted to the heating fixture 400 and configured to communicate with the radiant heater 410 and the detector 420. In one embodiment, the controller 430 is a programmable device configured to process a thermal image from an infant positioned within the tray 220 (FIG. 2). An infant skin temperature may be calculated in the controller or in the detector. In one embodiment, the controller 430 adjusts power to a single heating element or uniformly across a group of heating elements. In another embodiment, the controller 430 has or incorporates a thermography image processor so as to determine a skin temperature image of an infant within the tray 220 (FIG. 2). In a particular embodiment, the controller 430 may control one or more variables of the detector 422, the radiant heater 410 and/or the support 214 based upon this temperature image. In a further embodiment, the controller 430 may trigger one or more alarms 440, which may be visual, audible or both, so as to signal a high or low infant skin temperature, an abnormal or unusual skin temperature distribution, or that the infant is covered or that some other anomaly has occurred preventing an accurate infant skin temperature determination.

Figure 5:
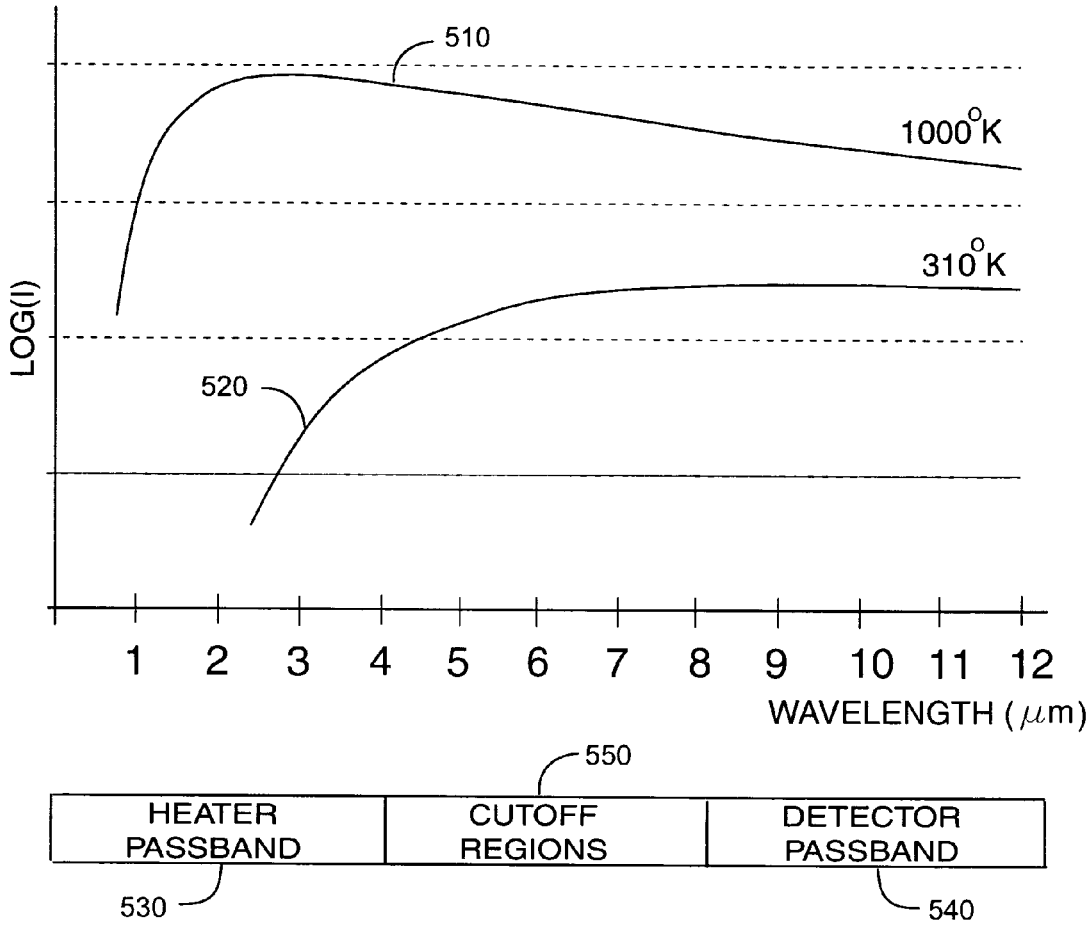
FIG. 5 is a log graph of blackbody radiation intensity versus wavelength at different temperatures.

FIG. 5 illustrates Planck curves 510, 520 of heater radiant energy and infant radiated energy. As an example, a heater at a temperature of 1000° K (1,340° F.) can be represented by a Planck curve 510 with peak radiation intensity at approximately 3 μm, with substantial radiation at wavelengths to 12 μm and beyond. By comparison, an infant at 310° K (98.3° F.) can be represented by a Planck curve 520 with peak radiation intensity at approximately 9 μm and with substantial radiation down to 4 μm. Due to infant skin reflectance, significant radiant energy from the heater 410 may be measured at the detector 420 as compared with infant radiated energy, as discussed above. In an embodiment, an interrupter 414 (FIG. 3) is used to block radiation from the heater during measurements of infant skin temperature. The interrupter may be positioned before or after the heater optics 412. Interruptor 414 (FIG. 3) examples include one or more of controller-triggered shutters or a chopper wheel having an opaque portion that intermittently blocks the radiant heater 410, to name a few. In an embodiment, the interrupter duty cycle is chosen to be relatively small for infant heating efficiency. The interrupter duration is chosen to be of sufficient length to make the skin temperature measurement. The interrupter or measurement frequency is chosen high enough to provide timely feedback of infant temperature changes. Although a heater temperature of 1000° K is shown by way of example, various other heater temperatures can be chosen for infant warmer purposes.

As shown in FIG. 5, in another embodiment, heater optics 412 (FIG. 3) or detector optics 422 (FIG. 3) or a combination of heater and detector optics 412, 422 (FIG. 3) are used to reduce or eliminate the effects of skin reflected heater radiant energy reaching the detector during skin temperature measurements. For example, a heater optic 412 (FIG. 3) can be chosen with band pass or high pass frequency characteristics having a pass band 530 and cutoff region 550 configured to only transmit radiation around the peak of the Planck curve 510. Similarly, a detector optic 422 (FIG. 3) can be chosen with a notch filter or a low pass frequency characteristic having a pass band 540 and cutoff region 550 configured to transmit radiation at least around the peak of the infant radiation, e.g. Planck curve 520 and to filter radiation at least around the peak of the heater radiation, e.g. Planck curve 510.

A remote sensing infant warmer has been disclosed in detail in connection with various embodiments. These embodiments are disclosed by way of examples only and are not to limit the scope of the claims that follow. One of ordinary skill in art will appreciate many variations and modifications.

What is claimed is:

1. An infant warmer comprising:

a base;

a tray mounted above the base;

a support extending from the base;

a fixture mounted to the support and extending over the tray;

a radiant heater disposed within the fixture configured to emit radiant energy so as to warm an infant placed in the tray;

a detector disposed proximate the fixture and configured to receive infant radiated energy;

an interruptor configured to at least intermittently at least partially block the heater radiant energy thereby reducing radiant energy reflected from infant skin at the detector during measurements of the infant radiated energy; and a controller in communications with the detector and the radiant heater, the controller configured to vary the radiant energy from the radiant heater responsive to measurements of the infant radiated energy so as to provide closed-loop regulation of infant warmth.

2. The infant warmer according to claim 1 further comprising an alarm responsive to the controller so as to indicate an anomalous infant temperature.

3. The infant warmer according to claim 1 further comprising a detector optic corresponding to the detector, the detector optic determining at least one of detector field-of-view, detector focus and received radiation bandwidth.

4. The infant warmer according to claim 1 further comprising a heater optic corresponding to the radiant heater, the heater optic determining at least one of bandwidth of the radiant energy, area within the tray exposed to the radiant energy, and location within the tray exposed to the radiant energy.

5. The infant warmer according to claim 1 wherein the controller is configured to calculate an approximate infant temperature responsive to one or more of the measurements of the infant radiated energy.

6. The infant warmer according to claim 1 wherein the controller derives a thermal image of an infant placed within the tray based upon an output of the detector.

7. The infant warmer according to claim 6, further comprising a detector optic corresponding to the detector and wherein the controller varies at least one of the detector optic, the heater optic and a distance from the tray to the radiant heater in response to the thermal image.

8. An infant warmer method comprising the steps of:

providing a heater to generate radiant energy to be absorbed by at least a portion of an infant;

at least partially interrupting skin-reflected heater radiant energy from being detected by a detector;

remotely sensing during the at least partial interrupting, infant radiated energy responsive to the heater radiant energy; and adjusting, responsive to the sensed infant radiated energy, the heater radiant energy that reaches the infant so as to control infant warmth.

9. The infant warmer method according to claim 8 comprising the further steps of:

positioning a the detector so as to view the infant, the detector responsive to the infant radiated energy; and outputting the detector response to a controller, the controller providing a closed-loop adjustment of the heater radiant energy that reaches the infant according to the detector response.

10. The infant warmer method according to claim 8 wherein at least partial interrupting comprises the substep of band-limiting a frequency of the heater radiant energy along a path from heater to detector so as to at least significantly reduce heater radiant energy within a substantial bandwidth proximate a peak wavelength of the infant radiated energy.

11. The infant warmer method according to claim 10 wherein the band-limiting substep comprising the further substep of providing at least one of a band-pass heater optic, a high-pass heater optic, a notch filter detector optic and a low-pass detector optic.

12. The infant warmer method according to claim 8 wherein the at least partial interrupting step comprises the substep of intermittently blocking the radiant energy from reaching the infant, the blocking occurring during measurements of the infant radiated energy.

13. The infant warmer method according to claim 8 wherein the adjusting step comprises the substep of modifying at least one of the temperature and the on-off duty cycle of the radiant heater.

14. The infant warmer method according to claim 8 wherein the adjusting step comprises the substep of modifying the distance between the infant and the radiant heater.

15. An infant warmer comprising:

means for holding an infant;

means for warming an infant;

means for positioning the means for warming so as to warm an infant;

means for remotely sensing infant radiated energy;

means for at least reducing skin-reflected radiant heater energy from affecting an accuracy of sensing infant radiated energy; and means for close-loop regulation of infant warmth in response to an output from the means for remotely sensing.

16. The infant warmer according to claim 15 further comprising a means for estimating infant warmth from the infant radiated energy.

* * * * *